US011692298B2

(12) United States Patent
Herman et al.

(10) Patent No.: US 11,692,298 B2
(45) Date of Patent: Jul. 4, 2023

(54) METHOD OF DRYING ARTICLES

(71) Applicant: WHIRLPOOL CORPORATION, Benton Harbor, MI (US)

(72) Inventors: Mark L. Herman, Saint Joseph, MI (US); Garry L. Peterman, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 66 days.

(21) Appl. No.: 17/363,335

(22) Filed: Jun. 30, 2021

(65) Prior Publication Data

US 2021/0324570 A1 Oct. 21, 2021

Related U.S. Application Data

(63) Continuation of application No. 16/850,828, filed on Apr. 16, 2020, now Pat. No. 11,078,619, which is a (Continued)

(51) Int. Cl.
*D06F 58/26* (2006.01)
*F26B 3/347* (2006.01)

(Continued)

(52) U.S. Cl.
CPC ..... *D06F 58/266* (2013.01); *F26B 3/347* (2013.01); *D06F 37/06* (2013.01); *D06F 58/04* (2013.01); *D06F 58/26* (2013.01)

(58) Field of Classification Search
CPC ..... A47K 10/05; A47K 10/10; F26B 3/347; A61M 21/00; A61M 2021/0016;

(Continued)

(56) References Cited

U.S. PATENT DOCUMENTS 1,503,224 A 7/1924 Blaine
1,871,269 A 8/1932 Hobrock (Continued)

FOREIGN PATENT DOCUMENTS

EP 0269358 A2 6/1988
EP 1753265 A1 2/2007

(Continued)

OTHER PUBLICATIONS

European Search Report for Counterpart EP16155782.2, dated Jul. 28, 2016.

(Continued)

*Primary Examiner* — Stephen M Gravini
(74) *Attorney, Agent, or Firm* — McGarry Bair PC

(57) ABSTRACT

A method for drying laundry with a radio frequency (RF) generator connected to an applicator and a rotatable cylindrical drum having a pair of non-anode baffles and a third baffle comprising an anode element positioned between the pair of non-anode baffles and a first cathode element disposed between the third baffle and one of the pair of non-anode baffles and a second cathode disposed between the third baffle and the other of the pair of non-anode baffles. The method comprises rotationally positioning the drum such that laundry is positioned between the anode element within the third baffle and the pair of non-anode baffles, energizing the RF applicator for a time period to generate a field of electromagnetic radiation (e-field) within the radio frequency spectrum between the anode element and the at least one of the first and second cathode elements such that liquid in laundry residing within the e-field will be dielectrically heated to effect a drying of the laundry during the time period, rotating the drum to redistribute laundry, and repeating the positioning the drum and energizing the RF applicator.

20 Claims, 6 Drawing Sheets

Related U.S. Application Data continuation of application No. 15/980,982, filed on May 16, 2018, now Pat. No. 10,655,270, which is a continuation of application No. 15/433,748, filed on Feb. 15, 2017, now Pat. No. 10,006,163, which is a continuation of application No. 14/665,238, filed on Mar. 23, 2015, now Pat. No. 9,605,899.

(51) Int. Cl.
*D06F 37/06* (2006.01)
*D06F 58/04* (2006.01)

(58) Field of Classification Search
CPC ..... D06F 59/02; D06F 59/08; D06F 58/04; D06F 58/26; D06F 25/266; D06F 37/06; F24H 3/02; F24H 9/2064; H01M 1/72415
USPC ..... 34/239, 595–610; 68/5 C, 19
See application file for complete search history.

(56) References Cited

U.S. PATENT DOCUMENTS 2,112,418 A 3/1938 Hart, Jr. et al.
2,212,522 A 8/1940 Hart, Jr. et al.
2,226,871 A 12/1940 Nicholas
2,228,136 A 1/1941 Hart, Jr.
2,231,457 A 2/1941 Stephen
2,276,996 A 3/1942 Milinowski
2,373,374 A 4/1945 Bierwirth
2,449,317 A 9/1948 Pitman
2,464,403 A 3/1949 Klingaman
2,473,251 A 6/1949 Hsu
2,492,187 A 12/1949 Rusca
2,511,839 A 6/1950 Frye
2,512,311 A 6/1950 Davis
2,542,589 A 2/1951 Stanton et al.
2,582,806 A 1/1952 Nes et al.
2,642,000 A 6/1953 Wieking
2,656,839 A 10/1953 Howard
2,740,756 A 4/1956 Thomas
2,773,162 A 12/1956 Christensen
3,089,327 A 5/1963 Stilwell, Jr.
3,161,480 A 12/1964 Birch-Iensen et al.
3,184,637 A 5/1965 Skinner
3,316,380 A 4/1967 Pansing
3,329,796 A 7/1967 Manwaring
3,355,812 A 12/1967 Bennett
3,364,294 A 1/1968 Garibian et al.
3,404,466 A 10/1968 Reid
3,426,439 A 2/1969 Ryman et al.
3,439,431 A 4/1969 Heidtmann
3,537,185 A 11/1970 Ingram
3,543,408 A 12/1970 Candor et al.
3,599,342 A 8/1971 Cotton
3,601,571 A 8/1971 Curcio
3,652,816 A 3/1972 Preston
3,701,875 A 10/1972 Witsey et al.
3,754,336 A 8/1973 Feild
3,878,619 A 4/1975 Hodgett et al.
3,953,701 A 4/1976 Manwaring
3,969,225 A 7/1976 Horowitz
4,014,732 A 3/1977 Beckert et al.
4,028,518 A 6/1977 Boudouris et al.
4,119,826 A 10/1978 Chambley et al.
4,197,851 A 4/1980 Fellus
4,296,298 A 10/1981 MacMaster et al.
4,296,299 A 10/1981 Stottmann et al.
4,334,136 A 6/1982 Mahan et al.
4,365,622 A 12/1982 Harrison
4,409,541 A 10/1983 Richards
4,471,537 A 9/1984 Meda
4,499,818 A 2/1985 Strong
4,523,387 A 6/1985 Mahan
4,529,855 A 7/1985 Fleck
4,625,432 A 12/1986 Baltes
4,638,571 A 1/1987 Cook
4,692,581 A 9/1987 Mizutani et al.
4,845,329 A 7/1989 Vaz et al.
4,918,290 A 4/1990 DeMars
4,949,477 A 8/1990 Geiger
5,064,979 A 11/1991 Jaeger
5,152,075 A 10/1992 Bonar
5,197,202 A 3/1993 Jensen
5,282,321 A 2/1994 Huttlin
5,303,484 A 4/1994 Hagen et al.
5,394,619 A 3/1995 Kaplan
5,495,250 A 2/1996 Ghaem et al.
5,553,532 A 9/1996 de la Luz-Martinez et al.
5,659,972 A 8/1997 Min et al.
5,692,317 A 12/1997 Manzolli
5,819,431 A 10/1998 Lancer
5,838,111 A 11/1998 Hayashi et al.
5,853,579 A 12/1998 Rummler et al.
5,877,090 A 3/1999 Padmapani et al.
5,886,081 A 3/1999 Sternowski
5,983,520 A 11/1999 Kim et al.
6,124,584 A 9/2000 Blaker et al.
6,189,231 B1 2/2001 Lancer
6,263,591 B1 7/2001 La Porte
6,303,166 B1 10/2001 Kolbe et al.
6,367,165 B1 4/2002 Huttlin
6,421,931 B1 7/2002 Chapman
6,531,880 B1 3/2003 Schneider et al.
6,546,109 B1 4/2003 Gnecco et al.
6,649,879 B1 11/2003 Kohlstrung
6,812,445 B2 11/2004 Gorbold
7,526,879 B2 5/2009 Bae et al.
7,619,403 B2 11/2009 Kashida
7,676,953 B2 3/2010 Magill
7,883,609 B2 2/2011 Petrenko et al.
RE43,519 E 7/2012 Gnecco et al.
8,499,472 B2 8/2013 Bari et al.
8,789,599 B2 7/2014 Parsche
8,826,561 B2 9/2014 Wisherd et al.
8,839,527 B2 9/2014 Ben-Shmuel et al.
8,943,705 B2 2/2015 Wisherd et al.
9,127,400 B2 9/2015 Herman et al.
9,173,253 B2 10/2015 Wohl et al.
9,194,625 B2 11/2015 Herman et al.
9,200,402 B2 12/2015 Wisherd et al.
9,410,282 B2 8/2016 Herman et al.
9,447,537 B2 9/2016 Wisherd et al.
9,540,759 B2 1/2017 Herman et al.
9,541,330 B2 1/2017 Herman et al.
9,546,817 B2 1/2017 Herman et al.
9,605,899 B2 3/2017 Herman et al.
9,645,182 B2 * 5/2017 Herman ..... G01R 29/12
9,784,499 B2 10/2017 Herman et al.
10,184,718 B2 1/2019 Herman et al.
10,184,748 B2 1/2019 Frank
10,323,881 B2 6/2019 Herman et al.
10,533,798 B2 1/2020 Herman et al.
10,655,270 B2 5/2020 Herman et al.
11,078,619 B2 * 8/2021 Herman ..... D06F 58/266
2002/0047009 A1 4/2002 Flugstad et al.
2003/0199251 A1 10/2003 Gorbold
2004/0149734 A1 8/2004 Petrenko et al.
2005/0120715 A1 6/2005 Labrador
2005/0278972 A1 12/2005 Maruca
2005/0286914 A1 12/2005 Nagahama
2006/0097726 A1 5/2006 Frederick et al.
2006/0289526 A1 12/2006 Takizaki et al.
2007/0045307 A1 3/2007 Tsui et al.
2007/0113421 A1 5/2007 Uhara et al.
2007/0193058 A1 8/2007 Zarembinski
2008/0134792 A1 6/2008 Lee et al.
2008/0256826 A1 10/2008 Zarembinski
2009/0151193 A1 6/2009 Moon et al.
2009/0172965 A1 7/2009 Campagnolo et al.
2009/0195255 A1 8/2009 Kalokitis et al.
2010/0043527 A1 2/2010 Marra
2010/0103095 A1 4/2010 Yamamoto et al.
2010/0115785 A1 5/2010 Ben-Shmuel et al.
2010/0146805 A1 6/2010 Kim et al.

(56) References Cited

U.S. PATENT DOCUMENTS

| | | | |
|---|---|---|---|
| 2011/0049133 | A1 | 3/2011 | Przybyla |
| 2011/0245900 | A1 | 10/2011 | Turner et al. |
| 2011/0308101 | A1 | 12/2011 | Wisherd et al. |
| 2012/0000087 | A1 | 1/2012 | Da Riol et al. |
| 2012/0164022 | A1 | 6/2012 | Muginstein et al. |
| 2012/0247800 | A1 | 10/2012 | Shah et al. |
| 2012/0291304 | A1 | 11/2012 | Wisherd et al. |
| 2013/0024169 | A1 | 1/2013 | Veerasamy |
| 2013/0119055 | A1 | 5/2013 | Wohl et al. |
| 2013/0201068 | A1 | 8/2013 | Alexopoulos et al. |
| 2013/0207674 | A1 | 8/2013 | Hahl et al. |
| 2013/0271811 | A1 | 10/2013 | Lam et al. |
| 2013/0316051 | A1 | 11/2013 | Van Der Voort et al. |
| 2014/0159716 | A1 | 6/2014 | Mccollough, Jr. et al. |
| 2014/0300369 | A1 | 10/2014 | Hart |
| 2014/0325865 | A1 | 11/2014 | Wisherd et al. |
| 2015/0020403 | A1 | 1/2015 | Herman et al. |
| 2015/0047218 | A1 | 2/2015 | Herman et al. |
| 2015/0052775 | A1 | 2/2015 | Herman et al. |
| 2015/0089829 | A1 | 4/2015 | Herman et al. |
| 2015/0101207 | A1 | 4/2015 | Herman et al. |
| 2015/0102801 | A1 | 4/2015 | Herman et al. |
| 2015/0159949 | A1 | 6/2015 | Herman et al. |
| 2015/0187971 | A1 | 7/2015 | Sweeney et al. |
| 2015/0364910 | A1 | 12/2015 | Konoto et al. |
| 2015/0377795 | A1 | 12/2015 | Zhao et al. |
| 2016/0281290 | A1 | 9/2016 | Herman et al. |
| 2016/0322343 | A1 | 11/2016 | Scanlan |
| 2017/0089639 | A1 | 3/2017 | Herman et al. |
| 2017/0350651 | A1 | 12/2017 | Herman et al. |
| 2018/0031316 | A1 | 2/2018 | Herman et al. |
| 2018/0266041 | A1 | 9/2018 | Herman et al. |
| 2019/0062914 | A1 | 2/2019 | King et al. |
| 2019/0128605 | A1 | 5/2019 | Herman et al. |
| 2019/0271504 | A1 | 9/2019 | Herman et al. |
| 2020/0149812 | A1 | 5/2020 | Herman et al. |
| 2020/0240071 | A1 | 7/2020 | Herman et al. |
| 2021/0078013 | A1 | 3/2021 | Kochhar et al. |
| 2021/0324570 | A1* | 10/2021 | Herman ..... F26B 3/347 |

FOREIGN PATENT DOCUMENTS

| | | | | |
|---|---|---|---|---|
| EP | 2827087 | A1 | 1/2015 | |
| EP | 2840340 | A2 | 2/2015 | |
| EP | 3073008 | A1 * | 9/2016 | ..... D06F 58/04 |
| EP | 3073008 | A1 | 9/2016 | |
| EP | 3073008 | B1 | 11/2017 | |
| GB | 601855 | A | 5/1948 | |
| GB | 1255292 | | 12/1971 | |
| GB | 2019543 | A | 10/1979 | |
| JP | 4307095 | A | 10/1992 | |
| WO | 2009106906 | A1 | 9/2009 | |
| WO | 2012001523 | A2 | 1/2012 | |

OTHER PUBLICATIONS

European Search Report for Corresponding EP14175081.0, dated Dec. 4, 2014.

European Search Report for Corresponding EP141785683., dated Feb. 16, 2015.

"British Help American Wounded: Rehabilitation and Treatment, UK, 1944", Ministry of Information Second World War Official.

European Search Report for Corresponding EP14179021.2, dated Feb. 3, 2015.

* cited by examiner

METHOD OF DRYING ARTICLES

CROSS-REFERENCE TO RELATED APPLICATION(S)

This application is a continuation of U.S. patent application Ser. No. 16/850,828, filed on Apr. 16, 2020, now U.S. Pat. No. 11,078,619, issued Aug. 3, 2021, which is a continuation of U.S. patent application Ser. No. 15/980,982, filed May 16, 2018, now U.S. Pat. No. 10,655,270, issued May 19, 2020, which is a continuation of U.S. patent application Ser. No. 15/433,748, filed Feb. 15, 2017, now U.S. Pat. No. 10,006,163, issued Jun. 26, 2018, which is a continuation of U.S. patent application Ser. No. 14/665,238, filed Mar. 23, 2015, now U.S. Pat. No. 9,605,899, issued Mar. 28, 2017, all of which are incorporated herein by reference in their entirety.

BACKGROUND OF THE INVENTION

Dielectric heating is a process in which a high-frequency alternating electric field or radio waves, or microwave electromagnetic radiation heats a dielectric material, such as water molecules. At higher frequencies, this heating is caused by molecular dipole rotation within the dielectric material, while at lower frequencies in conductive fluids, other mechanisms such as ion-drag are more important in generating thermal energy.

Microwave frequencies are typically applied for cooking food items and are considered undesirable for drying laundry articles because of the possible temporary runaway thermal effects associated with random application of the waves in a traditional microwave. Radiant heat applied to moving air is typically used for drying textile material.

Radio frequencies and their corresponding controlled and contained RF electronic fields (e-fields) have been used for drying of textile material. When applying an e-field to a wet article, such as a clothing material, the e-field may cause the water molecules within the e-field to dielectrically heat, generating thermal energy which is known to dry textile material more rapidly than radiant heat.

BRIEF DESCRIPTION OF THE INVENTION

One aspect of the disclosure is directed to a method for drying laundry with a radio frequency (RF) generator connected to an applicator and a rotatable cylindrical drum having a pair of non-anode baffles and a third baffle comprising an anode element positioned between the pair of non-anode baffles and a first cathode element disposed between the third baffle and one of the pair of non-anode baffles and a second cathode disposed between the third baffle and the other of the pair of non-anode baffles. The method comprises rotationally positioning the drum such that laundry is positioned between the anode element within the third baffle and the pair of non-anode baffles, energizing the RF applicator for a time period to generate a field of electromagnetic radiation (e-field) within the radio frequency spectrum between the anode element and the at least one of the first and second cathode elements such that liquid in laundry residing within the e-field will be dielectrically heated to effect a drying of the laundry during the time period, rotating the drum to redistribute laundry, and repeating the positioning the drum and energizing the RF applicator.

In another aspect, the disclosure is directed to a method for drying laundry with a radio frequency (RF) generator connected to an applicator and a rotatable cylindrical drum having a fixed anode element within a baffle and fixed first and second cathode elements positioned on opposite sides of the anode element and wherein the anode element and the entire first and second cathode elements are spaced relative to the drum such that the entire cathode element is angularly off-set from the anode element. The method comprises rotationally positioning the drum such that laundry is positioned between the anode element within the baffle and at least one of the first and second cathode elements, energizing the RF applicator for a time period to generate a field of electromagnetic radiation (e-field) within the radio frequency spectrum between the anode element and the angularly off-set cathode element such that liquid in laundry residing within the e-field will be dielectrically heated to effect a drying of the laundry during the time period, rotating the drum to redistribute laundry, and repeating the positioning the drum and energizing the RF applicator.

DESCRIPTION OF EMBODIMENTS OF THE INVENTION

While this description may be primarily directed toward a laundry drying machine, the invention may be applicable in any environment using a radio frequency (RF) signal application to dehydrate any wet article. While the term "laundry" may be used to describe the materials being dried, it is envisioned that embodiments of the invention may be used to dry any wet article, for instance, clothing, textiles, etc.

Figure 1:
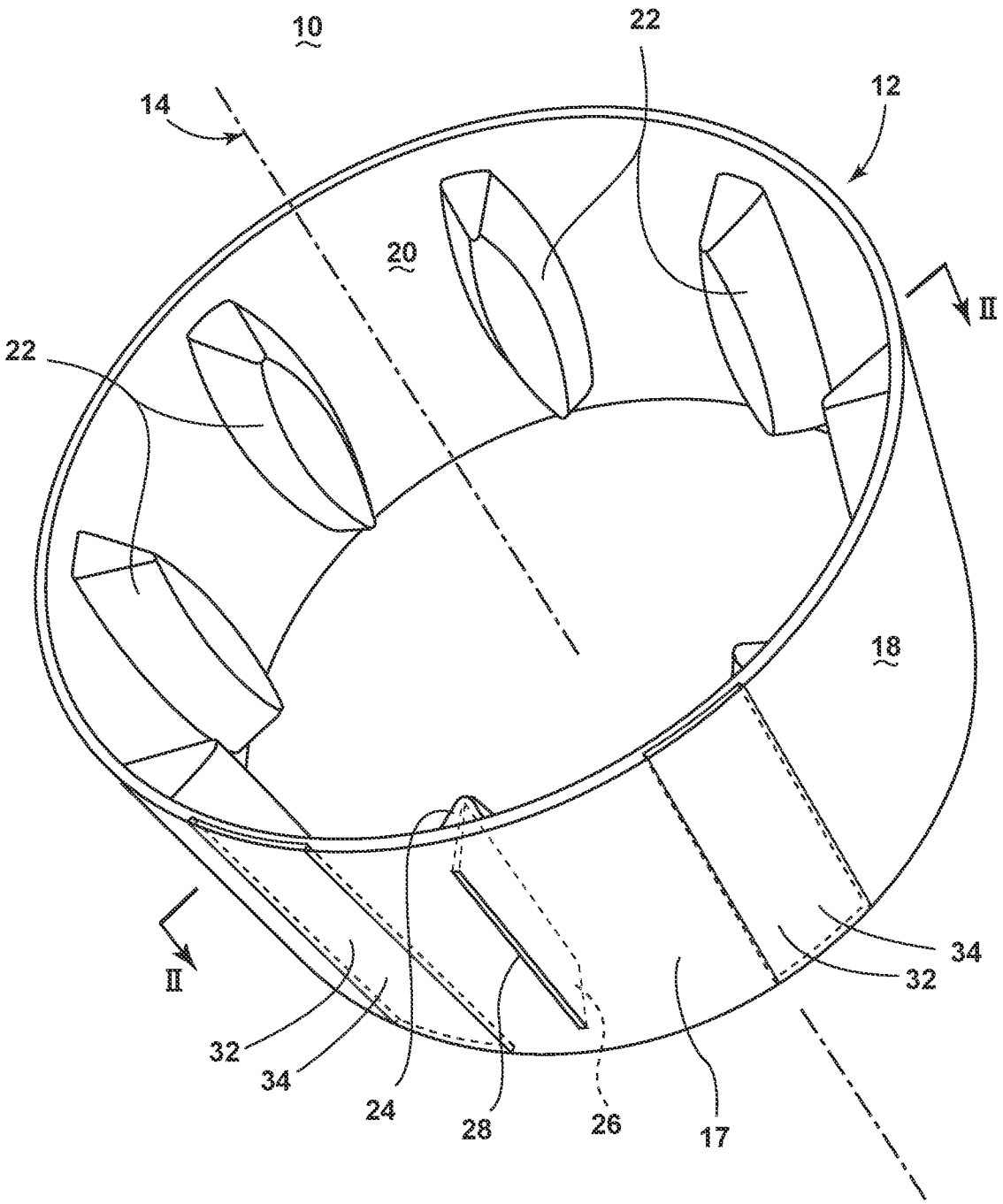
FIG. 1 is a schematic perspective view of the laundry treating applicator in accordance with the first embodiment of the invention.

FIG. 1 is a schematic illustration of a laundry treating applicator 10 according to the first embodiment of the invention for dehydrating one or more articles, such as articles of clothing. As illustrated in FIG. 1, the laundry treating applicator 10 includes a cylinder laundry support element, such as a drum 12, having a circumferential wall 17 configured to rotate about a non-vertical rotational axis 14. The circumferential wall 17 of the drum 12 further includes a non-conducting outer surface 18 and a non-conductive inner surface 20 for receiving and supporting wet laundry. The inner surface 20 further includes non-conductive tumble elements 22 supported by the inner surface 20, such as a plurality of at least partially, circumferentially, spaced baffles, to enable or prevent movement of laundry. While the plurality of baffles are described as circumferentially spaced, it is understood that the plurality of baffles may be angularly positioned about the circumferential wall 17 of the drum 12 at varied, unequal, or uneven spacing, relative to the wall 17 and/or drum 12. While eight baffles 22 are shown, alternative numbers of baffles 22 are envisioned.

At least one first baffle 24 further includes a conductive anode element 26 fixedly coupled with and positioned inside the at least one first baffle 22 such that the anode element 26 is electrically isolated from the laundry. At least one anode contact point 28 may extend through the circumferential wall 17 and is exposed on the outer surface 18 of the drum 12. The circumferential wall 17 of the drum 12 may further include at least one cathode element 32, illustrated as a cathode plate, fixedly coupled with or about (for example, on, within, or near) the circumferential wall 17 and extending over at least a portion of a radial segment of the circumferential wall 17, and circumferentially or angularly spaced from the anode element 26 along the circumference of the wall 17. In this sense, the cathode plate 32 is electrically isolated from the laundry and the anode element 26. In the illustrated example, the cathode plate 32 may be supported by, or disposed on, the outer surface 18 of the wall 17, however alternative embodiments may be included wherein the plate 32 is integrated into, or within, the wall 17 with a portion of the plate 32 exposed to define at least one cathode contact point 34. As used herein, "circumferentially spaced" is understood to any circumferential or angular spacing between the respective components, such as the baffles 22 or anode/cathode elements 26, 32. Moreover, the circumferential spacing may include any circumferential, angular, and/or dimensioned gap on at least one of the inner surface 20, outer surface 18, or interior portion of the circumferential wall 17, between any two respective components that may be positioned internal to, external to, or integrated within the circumferential wall 17. For example, as illustrated, the anode element 26 and cathode element 32 are circumferentially spaced since there is no radial overlap between the respective elements 26, 32. Furthermore, in addition to being circumferentially spaced from each other, the anode element 26 and cathode elements 32 may be spaced at a radial length from each other, with respect to the rotational axis 14. As used herein, a "radial length" may be the difference between the radii of at least a portion of either the anode or cathode elements 26, 32, with respect to the rotational axis 14. For example, the anode element 26 may extend within the baffle 22 toward the rotational axis 14, while the cathode element 32 is positioned on the outer surface 18 of the wall, having a radius farther from the rotational axis 14. Additionally, the anode and cathode elements 26, 32 may include respective overlapping or non-overlapping portions, with respect to the radial length from the rotational axis 14.

The surface area of each anode and/or cathode contact point 28, 34 exposed on the outer surface 18 of the drum 12 may vary from the illustrated example so that the contact points 28, 34 may be easier to couple with. For example, the anode and/or cathode contact points 28, 34 may be alternatively configured in axially and/or circumferentially spaced conductive strips that extend for a radial segment on the outer surface 18 of the drum 12. Alternatively, the anode and/or cathode contact points 28, 34 may be positioned on only an axial portion of the outer surface 18 of the drum 12, such as toward a front or a rear of the drum 12, or may be position and/or exposed on either axial end of the drum 12. Additional positions of the anode and/or cathode contact points 28, 34 may be included. Additionally, each anode element 26 and cathode plate 32 may be fixedly coupled to the circumferential wall 17 or to the respective baffle 24 by, for example, adhesion, fastener connections, or laminated layers. Alternative mounting techniques may be employed.

As shown, at least one cathode plate 32 may be positioned on each adjacent side of the at least one anode element 26. Moreover, embodiments of the invention may include positioning one or more cathode plates 32 closer to, or farther from the anode element 26, relative to the drum 12. Alternatively, one or more cathode plates 32 may be positioned relative to one or more baffles 22 of the drum 12. Additional embodiments may be included wherein, for instance, at least two anode elements 26 are radially arranged in an adjacently alternating configuration with at least two cathode plates 32 along at least a portion of, or even the full circumference of the drum 12. Yet another embodiment is envisioned wherein one set having an anode element 26 and one or more cathode plates 32 is radially opposed by a second set of an anode element 26 and one or more cathode plates 32. Additionally, while each anode element 26 and cathode plate 32 is shown extending an axial length, alternative lengths and placements are envisioned.

The circumferential wall 17 of the drum 12 may be made of any suitable dielectric, low loss, and/or fire retardant materials that isolate the conductive elements from the articles to be dehydrated. While a circumferential wall 17 is illustrated, other non-conductive elements are envisioned, such as one or more segments or layers of non-conductive elements, or alternate geometric shapes of non-conductive elements.

Figure 2:
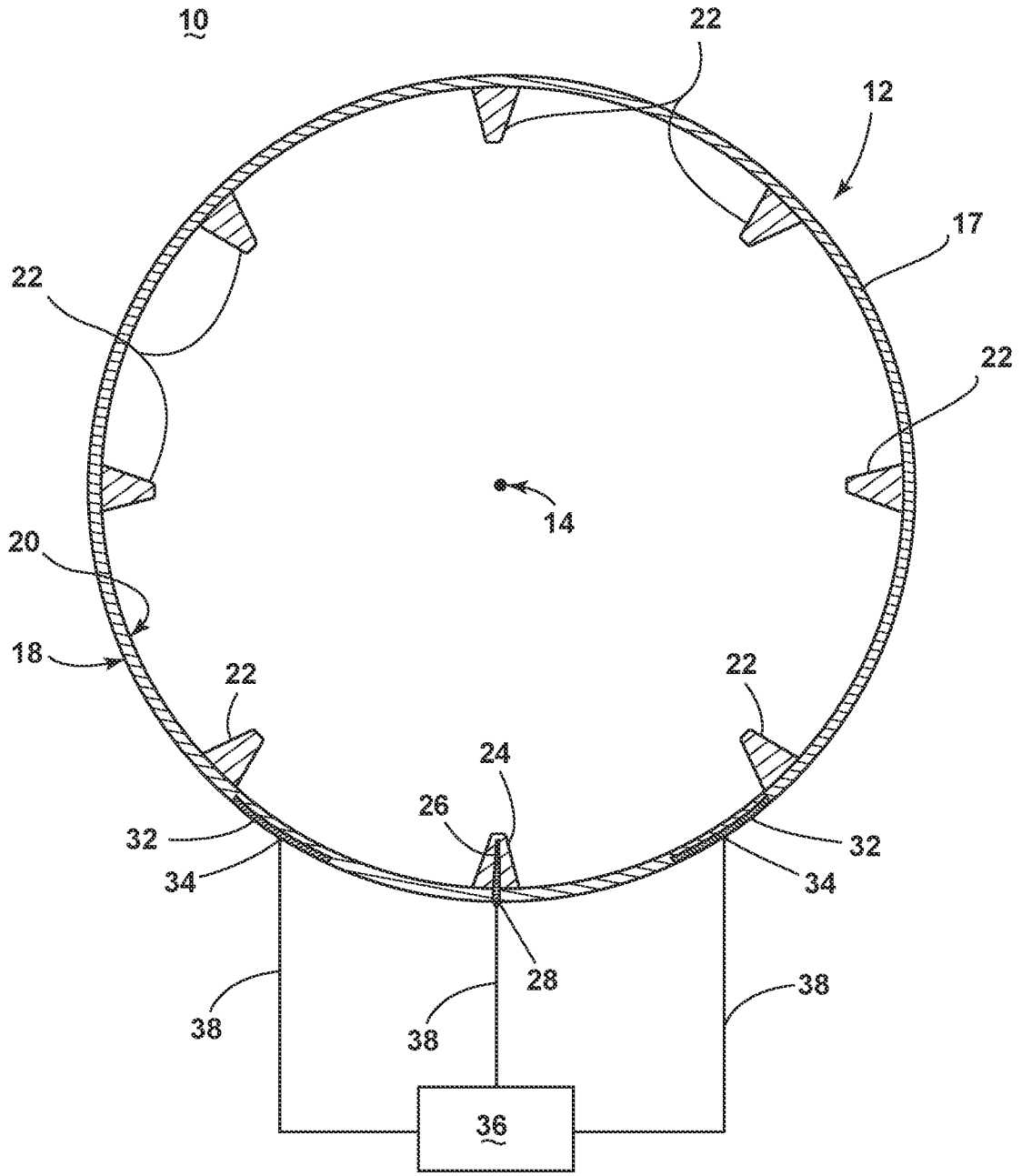
FIG. 2 is a partial sectional view taken along line 2-2 of FIG. 1 in accordance with the first embodiment of the invention.

Turning now to FIG. 2, the laundry treating applicator 10 further includes an RF generator 36 configured to be selectively energized to generate a field of electromagnetic radiation (e-field) within the radio frequency spectrum between output electrodes and may be electrically coupled, for instance, via conductors 38 with the anode element 26 and cathode plate 32 at each respectively positioned anode and cathode contact point 28, 34. One such example of an RF signal generated by the RF generator 36 may have a frequency of 13.56 MHz. The generation of another RF signal, or varying RF signals, is envisioned.

The RF generator 36 induces a controlled electromagnetic field between the anode element 26 and cathode plates 32. Stray-field or through-field electromagnetic heating provides a relatively deterministic application of power.

The coupling between the RF generator 36 and the anode element 26 and cathode plate 32 may be fixed or removable. For example, if the drum 12 is stationary while the laundry is agitated, a fixed coupling is envisioned. However, if the drum 12 rotates about the rotational axis 14, a semi-fixed coupling is envisioned, for instance, through slip rings at the point of rotation. Alternatively, if the drum 12 rotates about the rotational axis 14, a coupling is envisioned wherein, upon a stopping, slowing, or continuation of the rotation, moveable elements (not shown) may, for example, actuate in order to make contact with the respective anode and cathode contact points 28, 34. It is also envisioned that all anode elements 26 configured in the laundry treating applicator 10 will be coupled with the same RF signal from the RF generator 36. Likewise, it is envisioned that all cathode plates 32 will be coupled with the same RF signal from the RF generator 36, or a common ground from the laundry treating applicator 10. Alternatively, different or varying RF signals may be transmitted to multiple anode elements 26 and/or cathode plates 32.

During operation, a laundry load of one or more wet laundry articles is placed on the inner surface 20 of the laundry treating applicator 10, and the drum 12 may rotate at various speeds in either rotational direction according to a predetermined cycle of operation. In particular, the rotation of the drum 12 in combination with the physical interaction between the plurality of baffles 22 and the laundry load at various speeds causes various types of laundry movement inside the drum 12. For example, the laundry load may undergo at least one of tumbling, rolling (also called balling), sliding, satellizing (also called plastering), or combinations thereof. The terms tumbling, rolling, sliding and satellizing are terms of art that may be used to describe the motion of some or all of the fabric items forming the laundry load. However, not all of the fabric items forming the laundry load need exhibit the motion for the laundry load to be described accordingly.

Figure 3:
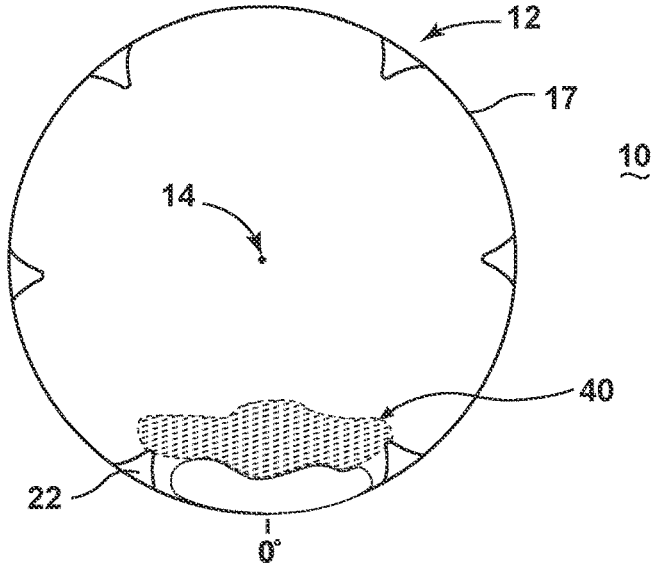
FIGS. 3-5 schematically illustrate, sequentially, a fabric load in a drum of the laundry treating applicator of FIG. 1 as the drum rotates and stops, which results in a flipping over of the fabric load.
Figure 4:
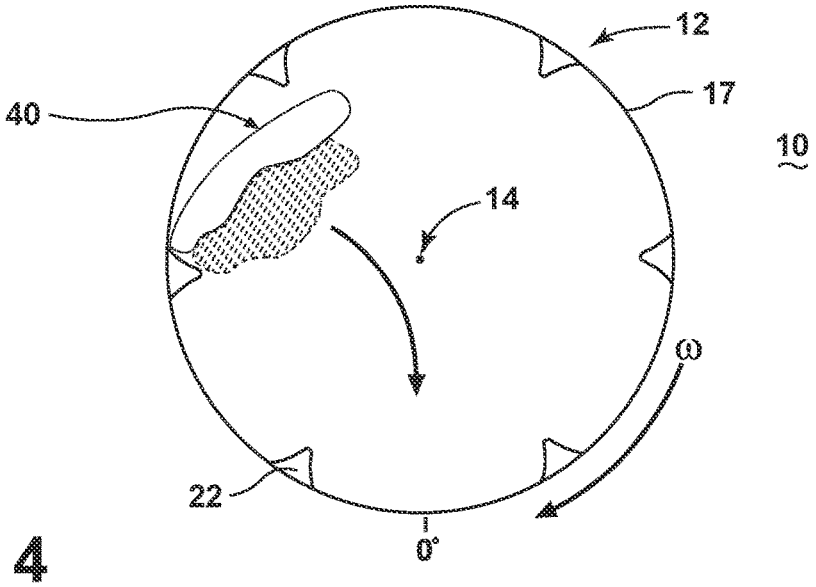
Figure 5:
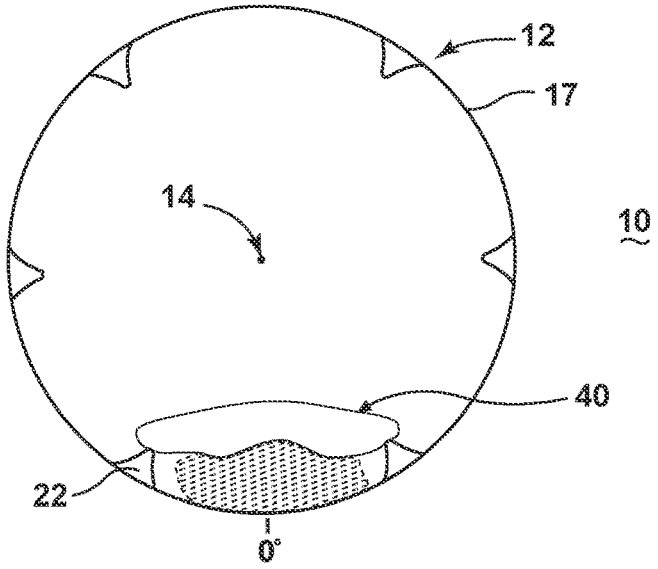

During tumbling, the drum 12 may be rotated at a tumbling speed such that the fabric items of the laundry load rotate with the drum 12 and are lifted from a lowest location towards a highest location by the plurality of baffles 22, but fall back to the lowest location before reaching the highest location. Typically, the centrifugal force applied by the drum 12 to the fabric items at the tumbling speeds is less than about 1G. FIGS. 3-5 illustrate such a lifting/falling movement using an exemplary laundry load 40 comprising multiple fabric items, which for convenience of illustration, is shown as having an upper portion (with dots) and a lower portion (without dots). In FIG. 3, the laundry load is illustrated as sitting at the lowest horizontal location, indicated as 0°, of the drum 12. As the drum 12 is rotated at some angular rate, indicated as ω, the laundry load 40 may follow along with the movement of the drum 12 and be lifted upwards as shown in FIG. 4. The lifting of the laundry load 40 with the drum 12 may be facilitated by either or both the centrifugal force acting on the laundry load and the lifting force applied by the baffles 22. As the laundry load 40 may be lifted up towards the highest location it eventually reaches a point where it will fall as indicated by the arrow in FIG. 4. The laundry load 40 will fall back to the lowest location as illustrated in FIG. 5. Depending upon the speed of rotation and the fabric items making up the laundry load 40, the laundry may fall off from the drum 12 at various points.

When the laundry load 40 falls back to the lowest location it may be flipped such that fabric items that were previously located on the bottom of the laundry load 40 are now located on the top of the laundry load 40. This physical phenomena results from the falling motion of the laundry load 40 in the drum 12. It should be noted that while a complete or perfect flipping of the laundry load 40 during falling may not occur, during every falling the fabric items in the laundry load 40 are often redistributed to some extent within the drum 12. After the laundry load 40 is returned to the lowest location, the process may be repeated or other control actions may be initiated within the laundry treating applicator 10. During the flipping action, the movement of the laundry load 40 through the cavity of the drum 12 may allow water to evaporate from the load 40. This process helps remove water that may otherwise be confined by the bundled laundry load 40. Additionally, using a signal from the RF generator 36, such as an applied voltage across the anode element 26 and cathode plate 32, the laundry treating applicator 10 may determine if wet or damp parts of the laundry load 40 are between the elements 26, 32, and may re-tumble the load 40 in response to this determination.

The drum 12 may cease rotation at a predetermined position, for instance, aligning the anode and cathode contact points 28, 34 with the anode element 26 and cathode plate 32, The predetermined position may also be defined wherein at least one set of baffles are located beneath the horizontal axis of the drum 12. In this predetermined position, gravity will distribute at least a portion of the laundry load 40 laterally between the baffles 22, 24 and/or anode and cathode elements 26, 32. The anode and cathode elements 26, 32 may be circumferentially or angularly spaced such that a substantial portion of the laundry load 40 is laterally positioned between the anode and cathode elements 26, 32, or between additional, alternating anode and cathode elements 26, 32. The predetermined position may be determined by any number of positioning elements configured to determine when the rotation of the drum 12 aligns the anode and cathode contact points 28, 34, with, respectively, the anode element 26 and cathode plate 32. Examples of the positioning elements may include, but are not limited to, one or more linear or angular sensors, Hall sensors, magnetic sensors, orientation sensors, mechanical sensors, optical sensors, or a device configured to determine the rotational position of the drum 12 based on another signal, such as a motor torque signal. Additionally, mechanical stopping elements may be utilized in aligning the anode and cathode contact points 28, 34 with the anode element 26 and cathode plate 32. For example, independently of, or in cooperation with any of the above-described positioning elements, a mechanical catch or mechanical break may be configured to stop the rotation of the drum 12 at a predetermined position (e.g. in alignment) after the rotational speed of the drum 12 falls below a rotational threshold value. Additional mechanical stopping mechanisms may be included.

The laundry treating applicator 10 creates a capacitive coupling between the at least one anode element 26 and the at least one cathode plate 32. The RF generator 36 may be continuously or intermittently energized to generate an e-field between the capacitively coupled anode and cathode elements, wherein the e-field sends electromagnetic frequencies through the applicator, via the capacitive coupling, which interacts with liquid in the laundry load 40. The liquid residing within the e-field, located above at least a portion of the inner surface 20 of the drum 12, will be dielectrically heated to effect a drying of the laundry load 40. The anode element 26 may capacitively couple to each adjacent cathode plates 32, whereupon the RF generator 36 will generate an e-field between each anode/cathode coupling.

The laundry treating applicator 10 may then cease the energization of the e-field, and initiate at least a partial rotation of the drum 12 to tumble the laundry load 40. The process of tumbling and selective energization of the e-field may continue for one or more cycles until the drying of the laundry load 40 has completed, as determined by sensors, timing, or the predetermined cycle of operation.

Many other possible configurations in addition to that shown in the above figures are contemplated by the present embodiment. For example, one embodiment of the invention contemplates different geometric shapes for the plurality of baffles 22 in the laundry treating applicator 10. Additionally, another example of the embodiment having more than one capacitive coupling sets of anode elements 26 and cathode plates 32 contemplates selectively energizing individual sets, all sets, or fewer than all sets. The selective energizing of individual sets, all sets, or fewer than all sets may be further related to the rotation of the drum 12, a predetermined position of the drum 12 during a continued or slowed rotation, or a predetermined stopped position of the drum 12.

The selective energizing of individual sets, all sets, or fewer than all sets may be further related to a determination of an impedance for the laundry load 40 or portion of the load 40, which may be indicative of wet laundry, and energizing individual sets, all sets, or fewer than all sets in response to the determination of the impedance. The selective energization may only energize the portion or portions of capacitive coupling sets positioned at or near the wet laundry.

Figure 6:
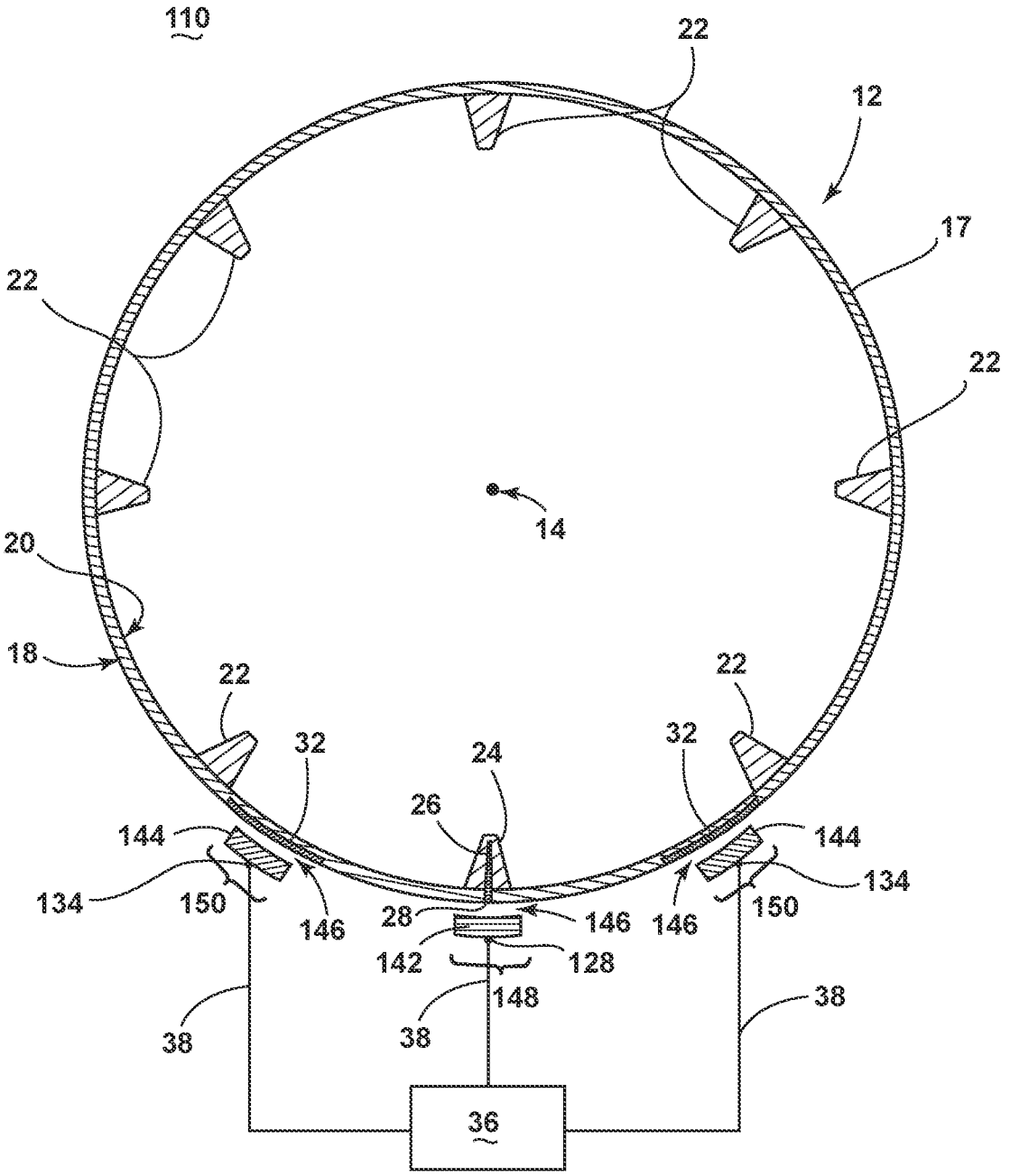
FIG. 6 is a partial sectional view showing an alternate assembled configuration of the drum and anode/cathode elements, in accordance with the second embodiment of the invention.

FIG. 6 illustrates an alternative laundry treating applicator 110 according to a second embodiment of the invention. The second embodiment may be similar to the first embodiment in some respects; therefore, like parts will be identified with like numerals increased by 100, with it being understood that the description of the like parts of the first embodiment applies to the second embodiment, unless otherwise noted. A difference between the first embodiment and the second embodiment may be that each anode element 26 and cathode plate 32 further includes a respective conductive second anode element 142 and a conductive second cathode element 144, each spaced from the element 26, 32 by, for example, an air gap 146. Alternate configurations are envisioned where only at least a portion of the drum 12, or other non-conducting element, separates the second anode and/or cathode elements 142, 144 from their respective anode element 26 and/or cathode plates 32. It may be envisioned that additional materials may be layered between the anode and cathode elements 26, 32, 142, 144.

Each second anode element 142 defines at least a partial first ring segment 148, while each second cathode element 144 defines at least a partial second ring segment 150 which may be different from the first segment 148. In this embodiment, the second anode and cathode elements 142, 144 may be fixedly mounted to a stationary (i.e. non-rotating) portion of the laundry treating applicator 110 such that the drum 12 rotates relative to the stationary elements 142, 144. Additionally, the RF generator 36 is electrically coupled with the second anode and cathode elements 142, 144 at respective anode and cathode contact points 128, 134.

The second embodiment of the laundry treating applicator 110 is configured such that the applicator 110 may create a first capacitive coupling between each anode element 26 and second anode element 142, a second capacitive coupling between each cathode element 32 and the second cathode element 144, and a third capacitive coupling between the anode element 26 and cathode plate 32.

During drying operations, the drum 12 may rotate about the rotational axis 14. After ceasing rotation in a predetermined position such that at least a portion of each second anode and cathode elements 142, 144 aligns with a portion of each respective anode element 26 and cathode plate 32, the RF generator 36 may be continuously or intermittently energized to generate an e-field between the first, second, and third capacitive couplings which interacts with liquid in the laundry. The liquid interacting with the e-field located within the inner surface 20 will be dielectrically heated to effect a drying of the laundry.

Additionally, alternate examples of the second embodiment of the invention may have more than one capacitive coupling sets of anode and cathode elements 26, 32, 142, 144. Similar to the first embodiment, the second embodiment contemplates selectively energizing individual sets, all sets, or fewer than all sets of capacitive couplings. The selective energizing of individual sets, all sets, or fewer than all sets may be further related to the rotation of the drum 12, or may be timed to correspond with one of aligned capacitive couplings, tumbling of the laundry, a predetermined position of the drum 12 during a continued or slowed rotation, a predetermined stopped position of the drum 12, an applied RF signal (such as voltage) may be used to detect alignment of the anode and cathode elements 26, 32, or power requirements of the laundry treating applicator 110. In another configuration, the second anode and cathode elements 142, 144 may encircle larger or smaller radial segments, or may completely encircle the drum 12 at axially spaced radial segments, as opposed to just partially encircling the drum 12.

Figure 7:
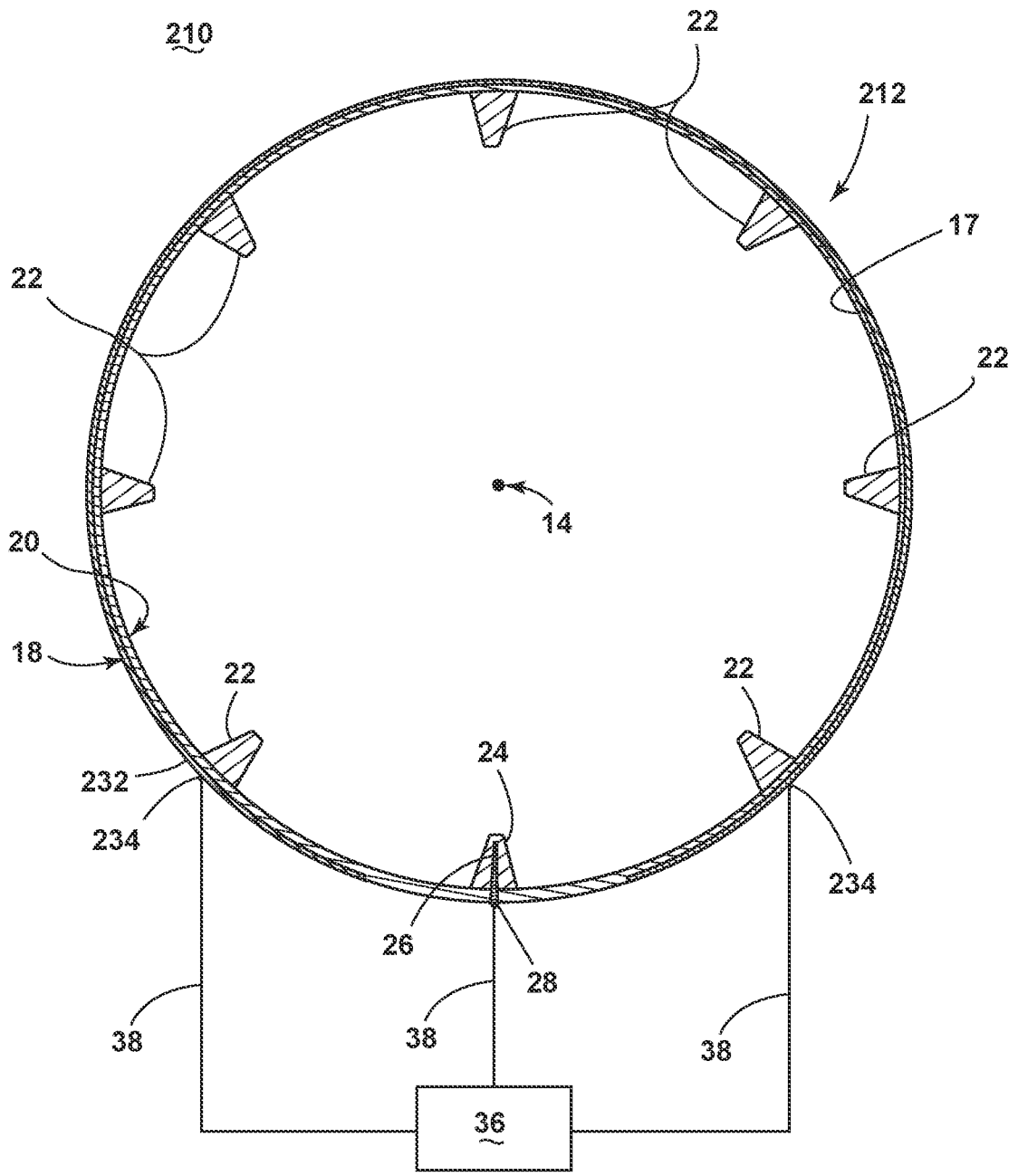
FIG. 7 is a partial sectional view showing an alternate assembled configuration of the drum and anode/cathode elements, in accordance with the third embodiment of the invention.

FIG. 7 illustrates an alternative laundry treating applicator 210 according to a third embodiment of the invention. The third embodiment may be similar to the first and second embodiments in some respects; therefore, like parts will be identified with like numerals increased by 200, with it being understood that the description of the like parts of the first embodiment applies to the second embodiment, unless otherwise noted. A difference between the first and second embodiments and the third embodiment may be that the cathode plate 232 may extend radially about a majority of the circumferential wall 17. In this embodiment, the RF generator 36 is electrically coupled with the single cathode plate 232 such that the e-field is sent through the majority of the cavity of the drum, dielectrically heating liquid within all laundry disposed within the drum 212.

Furthermore, in yet another embodiment of the invention, the laundry treating applicator 10 may have a set of anode and cathode elements 26, 32 in the axial front of the drum 12 and a second set of elements 26, 32 in the axial back of the drum 12. In this example, the laundry treating applicator 10 may independently energize the elements 26, 32 to provide drying of clothing in the front and back of the drum 12, for instance, based on the location of the laundry, or the location of wet or damp laundry. In another embodiment of the invention, the first baffle 24 and/or the anode element 26 may extend farther into the cavity of the drum 12 such that the first baffle 24 and/or anode element 26 are taller and/or distinguishable from the other baffles 22. Alternatively, the first baffle 24 and/or the anode element 26 may not extend into the cavity of the drum 12 as illustrated, such that the first baffle 24 and/or the anode element 26 are shorter than the other baffles 22. In either taller or shorter baffle 24 and/or anode element 26 embodiments, the height of the baffle 24 and/or anode element 24 may be configured based on, for example, a desired e-field pattern between the anode element 26 and the cathode element 32, or a desired tumbling pattern.

In yet another embodiment of the invention, the laundry treating applicator 10 may operate by rotationally positioning the drum 12 such that laundry is positioned between the circumferentially spaced anode element 26 and cathode element 32, followed by an energizing of the RF generator 36 for a predetermined, sensed, or variable time period to dry at least a portion of the laundry. Embodiments of the invention may then further rotate the drum 12 to reposition and/or redistribute the laundry, followed by repeating the positioning of the drum such that laundry is positioned between the anode and cathode elements 26, 32, and re-energizing the RF generator 36. The process may repeat, as needed, until, for example, the laundry and/or drying cycle has completed, a predetermined number of repeated steps have occurred, or a predetermined period of time has elapsed.

Figure 8:
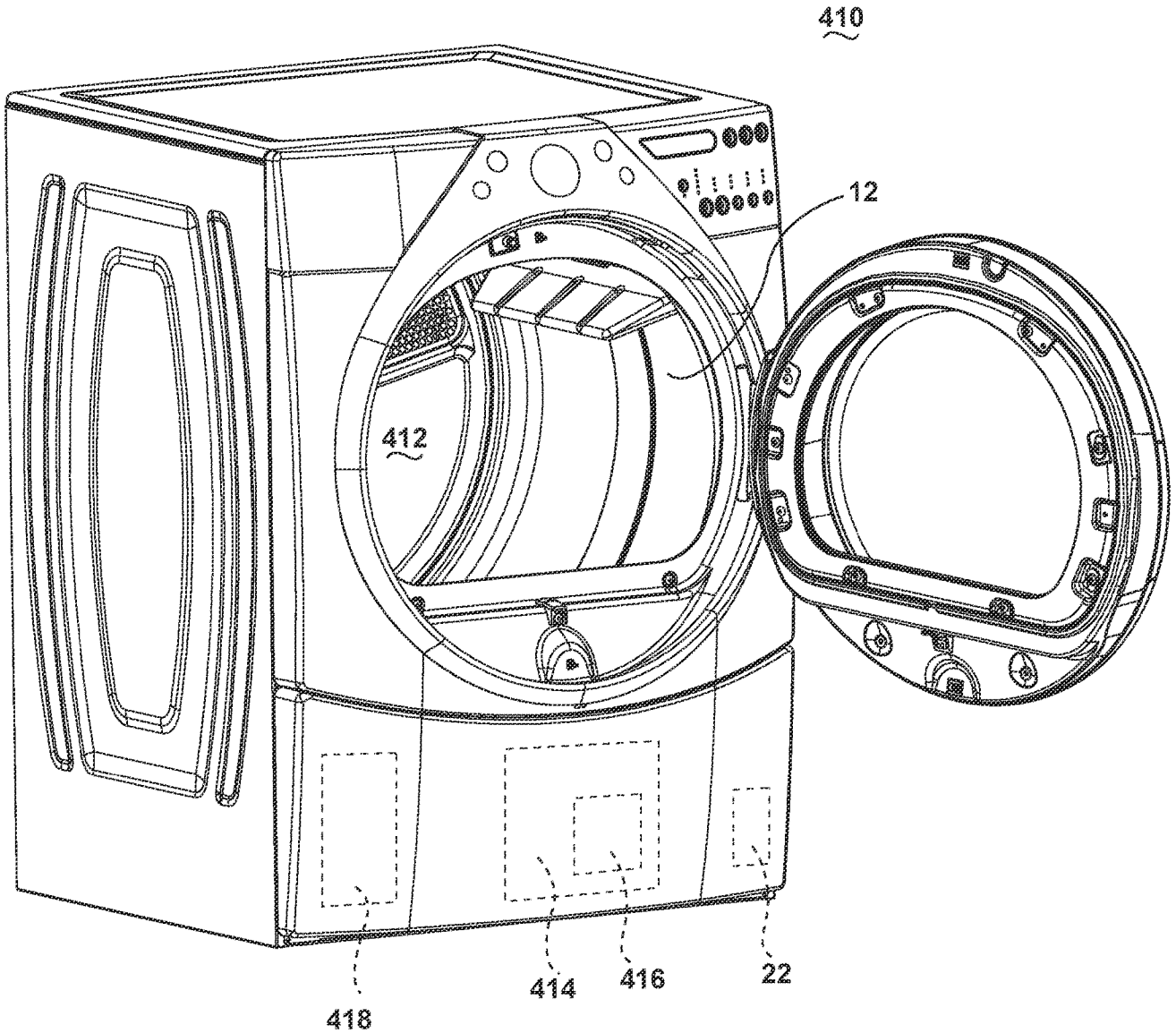
FIG. 8 is a schematic perspective view of an embodiment where the laundry treating applicator is shown as a clothes dryer incorporating the drum of the second, third, and fourth embodiments.

FIG. 8 illustrates an embodiment where the treating apparatus is a laundry treating appliance, such as a clothes dryer 410, incorporating the drum 12, 212 (illustrated as drum 12), which defines a treating chamber 412 for receiving laundry for treatment, such as drying. The clothes dryer comprises an air system 414 supplying and exhausting air from the treating chamber, which includes a blower 416. A heating system 418 is provided for hybrid heating the air supplied by the air system 414, such that the heated air may be used in addition to the dielectric heating. The heating system 418 may work in cooperation with the laundry treating applicator 10, as described herein.

The embodiments disclosed herein provide a laundry treating applicator using an RF generator to dielectrically heat liquid in wet articles to effect a drying of the articles. One advantage that may be realized in the above embodiments may be that the above described embodiments are able to dry articles of clothing during rotational or stationary activity, allowing the most efficient e-field to be applied to the clothing for particular cycles or clothing characteristics. A further advantage of the above embodiments may be that the above embodiments allow for selective energizing of the RF generator according to such additional design considerations as efficiency or power consumption during operation.

Additionally, the design of the anode and cathode may be controlled to allow for individual energizing of particular pair of cathode/anode elements inside the applicator in a single or multi-applicator embodiment. The effect of individual energization of particular RF element pairs results in avoiding anode/cathode pairs that would result in no additional material drying (if energized), reducing the unwanted impedance of additional anode/cathode pairs and electromagnetic fields inside the drum, and an overall reduction to energy costs of a drying cycle of operation due to increased efficiencies. Finally, reducing unwanted fields will help reduce undesirable coupling of energy into isolation materials between capacitive coupled regions.

Moreover, the capacitive couplings in embodiments of the invention may allow the drying operations to move or rotate freely without the need for physical connections between the RF generator and the anode and cathode elements. Due to the lack of physical connections, there will be fewer mechanical couplings to moving or rotating embodiments of the invention, and thus, increased applicator reliability.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A method for drying laundry with a radio frequency (RF) generator connected to an RF applicator and a rotatable cylindrical drum having at least first and second non-anode baffles and a third baffle comprising an anode element positioned between the at least first and second non-anode baffles and a first cathode element disposed between the third baffle and the first non-anode baffle and a second cathode disposed between the third baffle and the second non-anode baffle, the method comprising:

rotationally positioning the drum such that laundry is positioned between the anode element within the third baffle and the at least first and second non-anode baffles;

energizing the RF applicator for a time period to generate a field of electromagnetic radiation (e-field) within a radio frequency spectrum between the anode element and at least one of the first and second cathode elements such that liquid in laundry residing within the e-field will be dielectrically heated to effect a drying of the laundry during the time period;

rotating the drum to redistribute laundry; and repeating the positioning the drum and energizing the RF applicator.

2. The method of claim 1, wherein the first and second cathode elements are radially off-set from the anode element and positioned between the at least first and second non-anode baffles, with each of the first and second cathode elements having a cathode contact point at a circumferential wall on the drum.

3. The method of claim 1, further comprising rotating the drum about a non-vertical axis.

4. The method of claim 3, wherein at least one of the anode element or the first or second cathode elements extend at least a portion of a length parallel to the non-vertical axis.

5. The method of claim 3, wherein at least a portion of the first and second cathode elements are spaced by a radial length, with respect to the non-vertical axis, from the anode element.

6. The method of claim 1, further comprising intermittently or continuously energizing the RF generator.

7. The method of claim 1, wherein the first and second cathode elements are radially off-set from the anode element.

8. The method of claim 1, further comprising arranging the first and second cathode elements and the anode element in an alternating configuration.

9. The method of claim 2, further comprising radially extending the first and second cathode elements about a majority of the circumferential wall.

10. The method of claim 2, further comprising disposing the first and second cathode elements on an outer surface of the circumferential wall.

11. A method for drying laundry with a radio frequency (RF) generator connected to an RF applicator and a rotatable cylindrical drum having a fixed anode element within a baffle and fixed first and second cathode elements positioned on opposite sides of the anode element and wherein the anode element and the entire first and second cathode elements are spaced relative to the drum such that the entire cathode element is angularly off-set from the anode element, the method comprising:

rotationally positioning the drum such that laundry is positioned between the anode element within the baffle and at least one of the first and second cathode elements;

energizing the RF applicator for a time period to generate a field of electromagnetic radiation (e-field) within the radio frequency spectrum between the anode element and the angularly off-set cathode element such that liquid in laundry residing within the e-field will be dielectrically heated to effect a drying of the laundry during the time period;

rotating the drum to redistribute laundry; and repeating the positioning the drum and energizing the RF applicator.

12. The method of claim 1, further comprising positioning a non-anode baffles on an outside of the first and second cathode elements.

13. The method of claim 12, wherein the first and second cathode elements are radially off-set from the anode element and positioned between the non-anode baffles, with each of the first and second cathode elements having a cathode contact point at a circumferential wall on the drum.

14. The method of claim 11, further comprising rotating the drum about a non-vertical axis.

15. The method of claim 14, wherein at least one of the anode element or the first or second cathode elements extend at least a portion of a length parallel to the non-vertical axis.

16. The method of claim 14, wherein at least a portion of the first and second cathode elements are spaced by a radial length, with respect to the non-vertical axis, from the anode element.

17. The method of claim 11, wherein the first and second cathode elements are radially off-set from the anode element.

18. The method of claim 11, further comprising arranging the first and second cathode elements and the anode element in an alternating configuration.

19. The method of claim 13, further comprising radially extending the first and second cathode elements about a majority of the circumferential wall.

20. The method of claim 13, further comprising disposing the first and second cathode elements on an outer surface of the circumferential wall.

* * * * *